United States Patent [19]

Downing et al.

[11] 4,017,310

[45] Apr. 12, 1977

[54] METHOD FOR MAKING STRONTIUM ADDITIONS TO FERROSILICON

[75] Inventors: James Herbert Downing, Clarence; James Enoch Wells, III, Kenmore, both of N.Y.

[73] Assignee: Union Carbide Corporation, New York, N.Y.

[22] Filed: Dec. 31, 1975

[21] Appl. No.: 645,716

[52] U.S. Cl. ..... 75/129; 75/130 R; 75/135; 75/134 S

[51] Int. Cl.[2] ..... C22C 33/00

[58] Field of Search ..... 75/134 S, 129, 135, 75/130 R

[56] References Cited

UNITED STATES PATENTS

| | | | |
|---|---|---|---|
| 3,333,954 | 8/1967 | Dawson | 75/129 |
| 3,374,086 | 3/1968 | Goehring | 75/129 X |
| 3,527,597 | 9/1970 | Dawson | 75/129 X |
| 3,649,253 | 3/1972 | Kaess | 75/129 |

FOREIGN PATENTS OR APPLICATIONS

| | | | |
|---|---|---|---|
| 1,582,317 | 9/1969 | France | 75/134 S |
| 2,052,927 | 5/1971 | Germany | 75/134 S |

*Primary Examiner*—L. Dewayne Rutledge
*Assistant Examiner*—E. L. Weise
*Attorney, Agent, or Firm*—Frederick J. McCarthy, Jr.

[57] ABSTRACT

Addition of strontium to silicon or ferrosilicon using a mixture containing carbon and at least one material selected from the group of strontium oxide, and strontium carbonate and strontium sulfate.

6 Claims, No Drawings

METHOD FOR MAKING STRONTIUM ADDITIONS TO FERROSILICON

The present invention is directed to the addition of strontium to silicon or ferrosilicon. More particularly, the present invention is directed to the addition of strontium to molten silicon or ferrosilicon using mixtures of oxygen-bearing strontium compounds with carbon.

In the manufacture of silicon or ferrosilicon materials useful in the treatment of cast iron, it is important to provide such materials with a strontium content of on the order of 0.6–1.0% and higher.

A known and successful technique for this purpose using a master alloy containing strontium is disclosed in U.S. Pat. No. 3,374,086.

At times, however, it is not convenient to manufacture a strontium containing master alloy due to the equipment requirements for such a practice.

It is therefore an object of the present invention to provide additions of strontium to ferrosilicon without requiring the use of a strontium-containing master alloy.

Other objects will be apparent from the following description and claims.

A method in accordance with the present invention for making strontium additions comprises adding to molten silicon or ferrosilicon at a temperature in the range of 1,400° C to 1,700° C a mixture consisting essentially of carbon and at least one material selected from strontium oxide, strontium carbonate and strontium sulfate, the carbon in the mixture being in substantially the amount stoichiometrically required to reduce the selected material and form strontium carbide.

The stoichiometric requirements for the individual strontium bearing materials can be determined from the following equations:

$$SrO + 3C \rightarrow SrC_2 + CO$$

$$SrCO_3 + 4C \rightarrow SrC_2 + 3CO$$

$$SrSO_4 + 4C \rightarrow SrC_2 + SO_2 + 2CO$$

In the practice of the present invention, finely divided carbon, e.g. thermatomic carbon is blended with a selected strontium compound, or a mixture of such compounds, suitably sized Fisher Subsieve Average Diameter 2.5 micron and formed into compacts, suitably briquettes, using conventional binders such as mogul.

The compacts are then added to molten silicon or ferrosilicon (e.g. 50 to 78 Si) which is at a temperature of about 1400° C to 1700° C in amounts to provide the desired strontium content (e.g. about 0.60—1.00% Si) in the molten metal. Conventional stirring apparatus such as gas stirring or mechanical or induction stirring is suitably employed.

Upon addition of the compacts, the consituents react with the formation of strontium carbide which readily combines with the silicon in the surrounding molten metal. Strontium recoveries of from about 30 to 60% can be obtained using additions in accordance with the present invention.

The following examples will further illustrate the present invention.

EXAMPLE I

A mixture was prepared having the following porporations:

$SrCO_3$* 100 parts;
Thermatomic Carbon 32 parts;
Mogul binder 3 parts.

*Chemical Grade, Kaiser Refractories 2.5 micron Fisher Subsieve diameter.

The mixture was formed into prills by contacting the dry mix with moisture in a twin shell blender. The prills were dried and screened before they were added to molten ferrosilicon.

70 g. of prills (4 × 20 mesh) were added to 1000 g. of molten 75% ferrosilicon (75% Si, 0.5% max Al 0.10% max Ca, balance Fe) contained in a graphite crucible in an argon atmoshpere. The melt and prills were agitated with a graphite impeller (6 bladed turbine). The temperature of the melt was about 1400° C. After 20 minutes analysis of the treated ferrosilicon showed 1.48% Sr for a strontium recovery of 49%.

EXAMPLE II 50 g. of $SrCO_3$ of the type used in Example I were added to 1000 g. of molten 75% ferrosilicon (75% Si, 0.5% max. Al, 0.1% Ca balance Fe) contained in a graphite crucible in an argon atmosphere. The melt and $SrCO_3$ addition were agitated with a graphite impeller (6 bladed turbine). The temperature of the melt was about 1500° C. After 20 minutes, analysis of the treated ferrosilicon showed 0.54% Sr for a strontium recovery of 18%.

The benefits from an addition of $SrCO_3$+4C in accordance with the present invention can be shown by comparing the above Example II with Example I.

In order to achieve optimum recovery of strontium, the strontium-bearing addition materials should be shielded from exposure to oxygen or air, by maintaining the molten metal under a non-oxidizing atmosphere, e.g., vacuum or inert gas, or by maintaining the addition agent below the surface of the molten metal.

The mesh sizes referred to herein are United States Sieve Series. What is claimed is:

1. A method for adding strontium to silicon or ferrosilicon which comprises adding to molten silicon or ferrosilicon at a temperature in the range of 1400° to 1700° C a mixture consisting essentially of carbon and at least one material selected from the group consisting of strontium oxide, strontium carbonate and strontium sulfate, the carbon in said mixture being in substantially the amount required to reduce the selected material and form strontium carbide.

2. A method in accordance with claim 1 wherein said mixture is in the form of compacts made from finely divided materials.

3. A method in accordance with claim 1 wherein said selected material is strontium oxide.

4. A method in accordance with claim 1 wherein said selected material is strontium carbonate.

5. A method in accordance with claim 1 wherein said selected material is strontium sulfate.

6. A method in accordance with claim 1 wherein said molten metal is maintained in a non-oxidizing environment.

* * * * *